United States Patent [19]

Beno et al.

[11] Patent Number: 4,957,235

[45] Date of Patent: Sep. 18, 1990

[54] PAPER TRIMMER

[76] Inventors: Steven J. Beno; Joseph R. Mango, both c/o Ideal School Supply Corporation, 2245 Delany Rd., Waukegan, Ill. 60087

[21] Appl. No.: 326,929

[22] Filed: Mar. 22, 1989

[51] Int. Cl.[5] ..... B25C 7/00

[52] U.S. Cl. ..... 227/156; 83/607; 83/609; 83/701; 83/468; 108/25; 227/76; 269/900

[58] Field of Search ..... 83/167, 468, 585, 607, 83/609, 701; 108/25, 26; 227/67, 76, 156; 248/346; 269/289 R, 296, 900

[56] References Cited

U.S. PATENT DOCUMENTS

| | | | |
|---|---|---|---|
| 215,205 | 5/1979 | Bradley | 83/585 |
| 776,355 | 11/1904 | Selander | 108/25X |
| 1,803,830 | 5/1931 | Arey et al. | 108/25 X |
| 1,867,768 | 7/1932 | Schulzke | 108/25 |
| 1,906,213 | 4/1933 | Neuschotz et al. | 108/25 |
| 2,103,217 | 12/1937 | Ford | 83/585 |
| 2,254,374 | 9/1941 | Laukhoff | 83/585 X |
| 2,256,606 | 9/1941 | Blanc | 83/585 X |
| 2,345,450 | 3/1944 | Blanc | 83/607 X |
| 4,354,601 | 10/1982 | Harrison | 108/25 X |
| 4,807,538 | 2/1989 | Hoffman | 108/25 |

*Primary Examiner*—Paul A. Bell

*Attorney, Agent, or Firm*—Wood, Phillips, Mason, Recktenwald & VanSanten

[57] ABSTRACT

A paper trimmer including a base having an upper surface for supporting paper to be cut by a cutter structure pivotally mounted to one edge of the base. Structure is associated with the base for carrying associated office supply and office device elements, such as paper clips, an adhesive tape dispenser, a stapler, and a staple remover. Recesses are provided in a wall portion associated with the base for receiving the stapler, paper clips, and staple remover, and a cover is removably mounted to the wall for selectively closing the recess containing the paper clips. The tape dispenser is removably mounted to a rear edge portion of the base and forms an integral part thereof in the paper trimmer assembly. A lock is provided for selectively locking the movable cutter blade handle in a lowermost position. A fingertip protecting element is mounted to the base overlying the fixed cutter blade on the base. A slider is mounted on the rear edge portion off the base cooperating with a scale for indicating distances from the cutter blades.

29 Claims, 2 Drawing Sheets

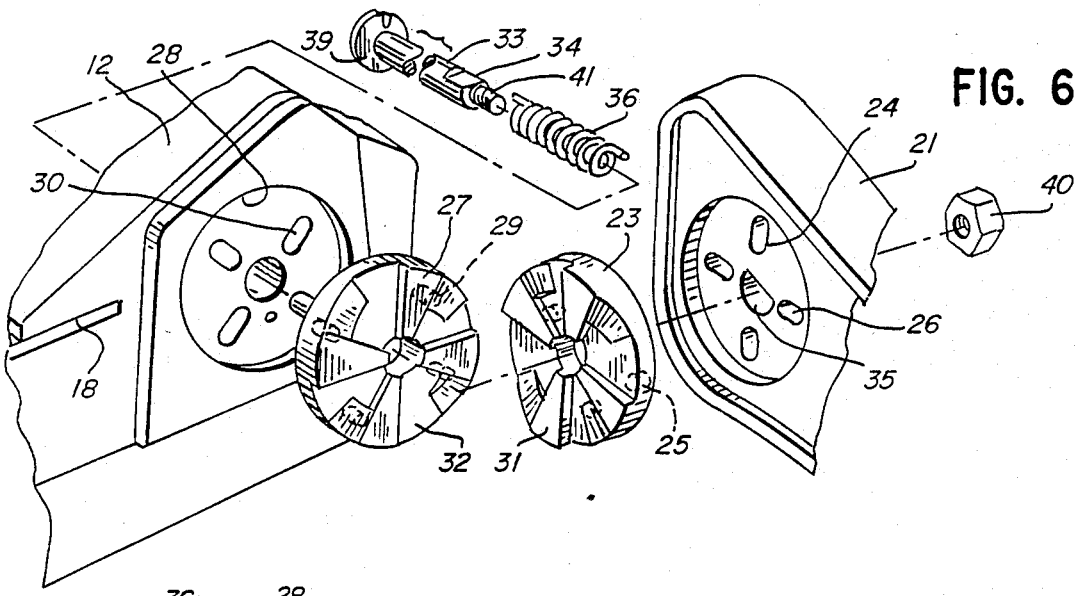
FIG. 6
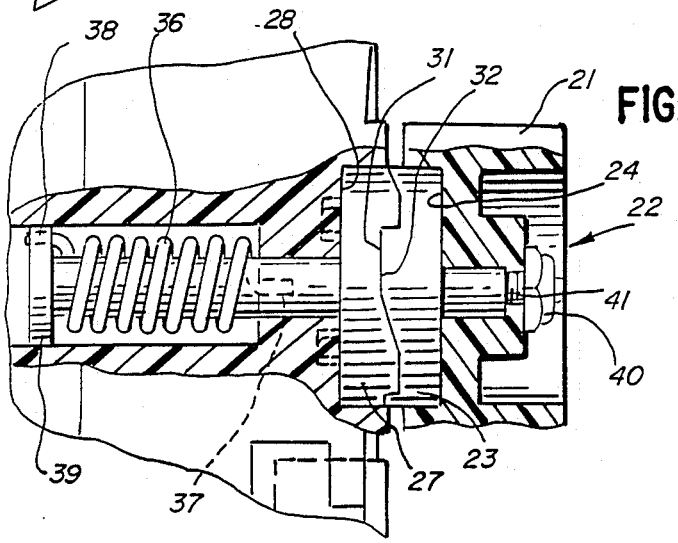
FIG. 7
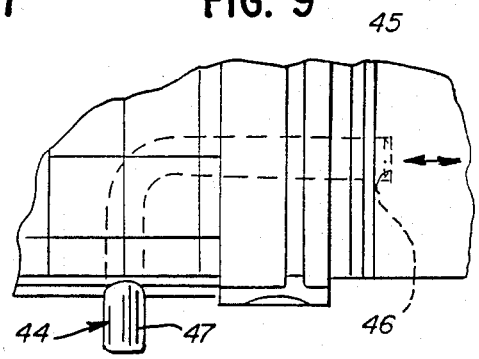
FIG. 9
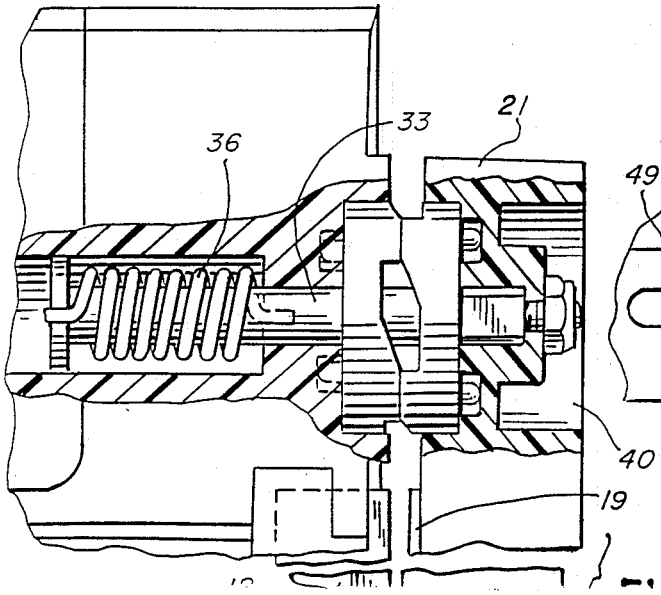
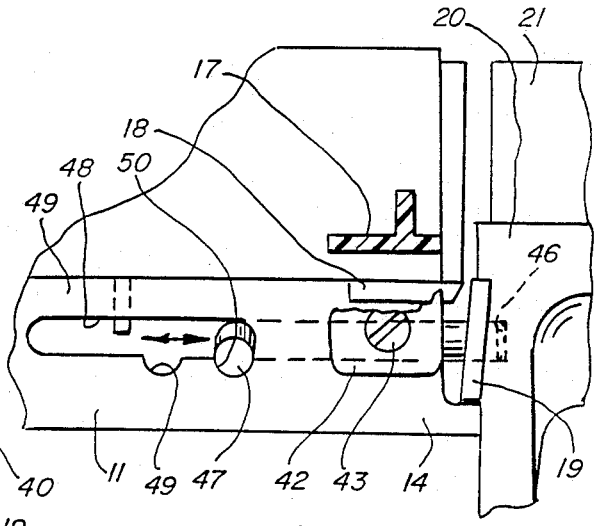
FIG. 10

PAPER TRIMMER

TECHNICAL FIELD

This invention relates to paper trimmers and in particular to paper trimmers having a pivotally mounted cutter at one edge of a base.

BACKGROUND ART

In one conventional form of paper trimmer, a base is provided for supporting paper to be cut by a cutter blade pivotally mounted to a one edge portion of the base.

It is common in offices to provide, in the same general area in which the paper trimmer is located, additional office supplies and equipment. Thus, it is conventional to provide such paper trimmers adjacent photocopying machines, stapling devices, adhesive tape dispensers, containers of paper fasteners, staple removers, etc.

A problem arises in such conventional arrangements in that the different devices and supplies are indiscriminately provided on tabletops, and the like, making it difficult at times to locate the specific device or supply required Additionally, the random placement of the devices and supplies on the working surfaces interferes with efficient paper handling, particularly where a number of people are utilizing the devices and supplies.

DISCLOSURE OF INVENTION

The present invention comprehends an improved paper trimmer having means associated therewith for retaining one or more forms of office supplies and devices The invention comprehends the provision of a paper trimmer having an edge portion adjacent the paper supporting surface of the trimmer for carrying such devices or supplies.

In the illustrated embodiment, the paper trimmer includes edge portions adjacent the paper supporting portion arranged to carry a plurality of different supplies and/or devices.

More specifically, the invention comprehends the provision of a paper trimmer including a base defining an upper surface for supporting paper to be cut, opposite side edge portions, and a rear edge portion, wall means disposed at one of the side edge portions of the base having an upwardly opening recess for removably holding objects including office supply objects, a dispenser on the base rear edge portion, cutter means disposed at the other of the side edge portions of the base for cutting a projecting portion of paper disposed on the base upper surface, the cutter means including a fixed blade on the base and a movable blade pivotally mounted to the base, and cam means for resiliently biasing the movable blade against the fixed blade during a paper cutting operation.

In the illustrated embodiment, the paper trimmer includes wall means disposed at one of the side edge portions of the base has a plurality of upwardly opening recesses for removably holding objects, including office supply objects In the illustrated embodiment, the wall means includes cover means for removably covering at least one of the upwardly opening recesses therein.

In the illustrated embodiment, the cover means is hingedly mounted to the wall means.

The wall means defines an upper surface flush with the upper surface of the base, in the illustrated embodiment The invention comprehends the provision in the wall means of a notch opening horizontally into one of the upwardly opening recesses and, in the illustrated embodiment, a plurality of such notches are provided, one each opening into different ones of the upwardly opening recesses.

The rear edge portion of the base is provided with a scale and an indicator slidably carried on the rear edge portion adjacent the scale for indicating distances from the paper cutting means.

A dispenser, in the illustrated embodiment, is disposed rearwardly of the scale and comprises an adhesive tape dispenser.

The wall means, in the illustrated embodiment, is formed unitarily integral with the base.

The paper trimmer further includes means for removably mounting the dispenser to the rear edge portion of the base.

In the illustrated embodiment, the base and wall means are formed of molded synthetic resin.

In the illustrated embodiment, the wall means removably carries a stapler, paper clips, and a staple remover.

The invention comprehends an improved cam means for resiliently biasing the movable blade against the fixed blade of the cutter means.

The cam means, in the illustrated embodiment, comprises means for spacing the movable blade from the fixed blade in a retracted disposition of the movable blade.

The invention further comprehends the provision of means for selectively locking the movable blade against movement away from the fixed blade.

The paper trimmer of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein:

FIG. 6 is an exploded perspective view illustrating the construction of the cutter blade pivot means;

FIG. 7 is a fragmentary horizontal section illustrating the arrangement of the pivot means, with the movable blade in an uppermost position;

FIG. 8 is a horizontal section similar to that of FIG. 7, but with the movable cutter blade in a lowered paper cutting position;

FIG. 9 is a fragmentary plan view illustrating the means for locking the movable cutter blade in a lowermost position; and FIG. 10 is a fragmentary front elevation thereof.

BEST MODE FOR CARRYING OUT THE INVENTION

Figure 1:
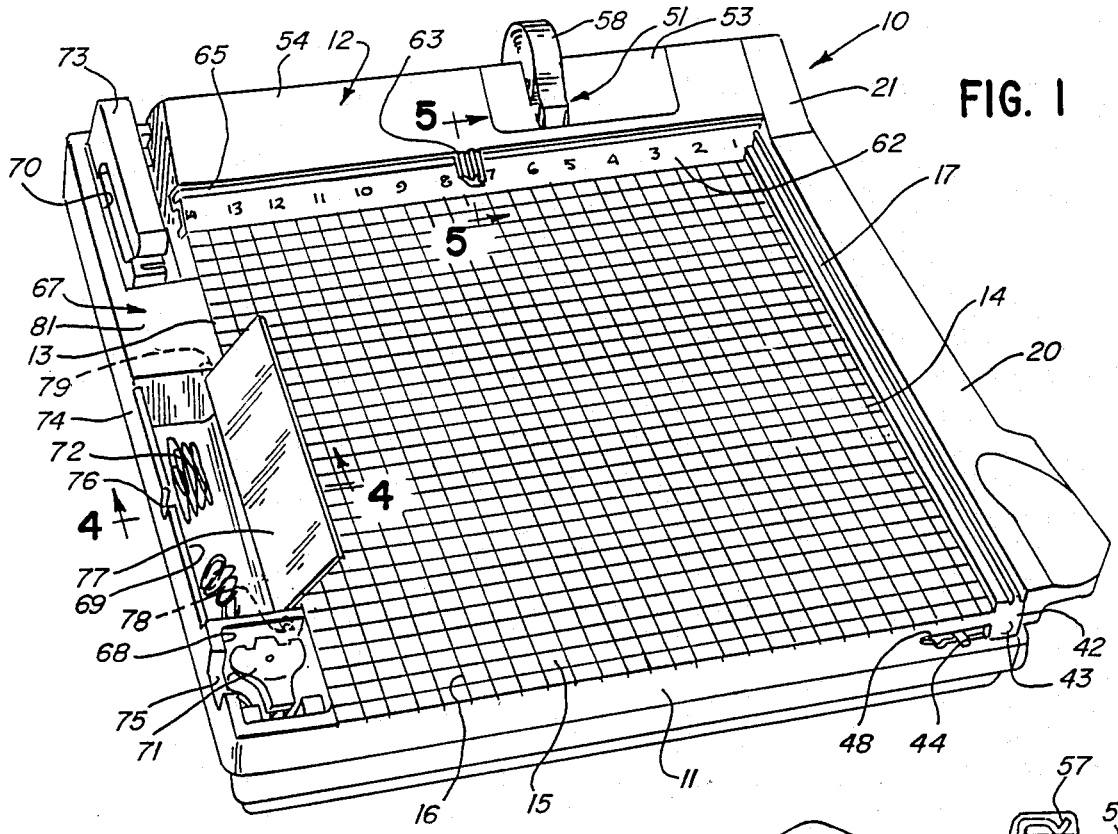
FIG. 1 is a perspective view of a paper trimmer embodying the invention.

In the illustrative embodiment of the invention as disclosed in the drawing, a paper trimmer generally designated 10 is shown to comprise a base 11 having a rear edge portion 12, a left edge portion 13, and a right edge portion 14.

Base 11 defines an upper paper supporting surface 15 provided with a grid 16. A fingertip guard 17 is mounted to the base in upwardly spaced relationship to a fixed cutter blade 18 extending along the edge portion 14 of the base.

As seen in FIG. 10, the fixed cutter blade 18 extends outwardly from the base right edge portion 14 for cooperation with a movable cutter blade 19 carried on a handle 20 having a rear portion 21 pivotally mounted to the rear edge portion 12 of the base by a pivot cam structure generally designated 22.

As shown in FIGS. 6–8, the cam structure 22 includes a first cam 23 mounted in a recess 24 in the rear end portion of the handle by means of outwardly projecting pins 25 received in complementary holes 26 opening into the recess 24. A second cam 27 is mounted to the rear edge portion 12 of the base in a recess 28 therein by means of pins 29 received in complementary holes 30 opening into the recess 28.

Cams 23 and 27 define camming surfaces 31 and 32 respectively.

The cams are rotatively mounted to a shaft 33 having a flatted end portion 34 extending through a complementary flatted cylindrical opening 35 in the handle end portion 21 shown in FIG. 6. A helical spring 36 is coaxially mounted to the opposite end of the shaft, having one end 37 fixed to the base rear edge portion 12 and an opposite end 38 fixed to an enlarged end portion 39 of the shaft. The spring is under compression urging the shaft to the left, as seen in FIG. 7, thereby urging the camming surface 31 against camming surface 32.

A nut 40 is threadedly secured to a threaded distal end 41 of the shaft to secure the shaft to the handle rear portion 21, as shown in FIG. 7.

As seen in FIGS. 7 and 8, the camming action serves to urge the movable blade 19 toward and away from the fixed blade 18 in the swinging movement of the handle arm 20. Spring 36 effects a resilient biasing of the movable blade 19 against the distal edge of the fixed blade 18 in effecting the improved cutting of the paper in the paper trimming operation.

As seen in FIG. 10, the fingertip guard 17 is spaced above the fixed cutter blade 18. The fingertip guard defines a front flange 42 which is downturned about the front edge of the base and secured thereto by a suitable screw 43, as seen in FIGS. 1 and 10.

Handle 20 is locked in the lowermost disposition of FIG. 1, when desired, by a lockpin 44 having one end 45 removably received in a complementary recess 46 in the front end of the handle 20, and an opposite, forwardly turned end 47 projecting forwardly through a slot 48 in the front wall 49 of the base 11.

As shown in FIG. 10, the slot includes a pair of notches 49 and 50 for selectively retaining the lockpin in the locking position shown in FIGS. 1, 9 and 10, and in a retracted position wherein the lockpin end 47 is received in the notch 49, permitting free swinging movement of the handle 20 and movable cutter blade 19 carried thereby.

Figure 2:
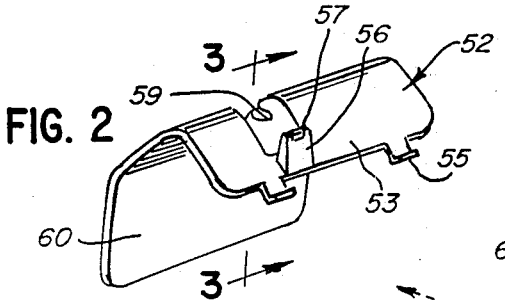
FIG. 2 is a perspective view of the tape dispenser means of the paper trimmer.
Figure 3:
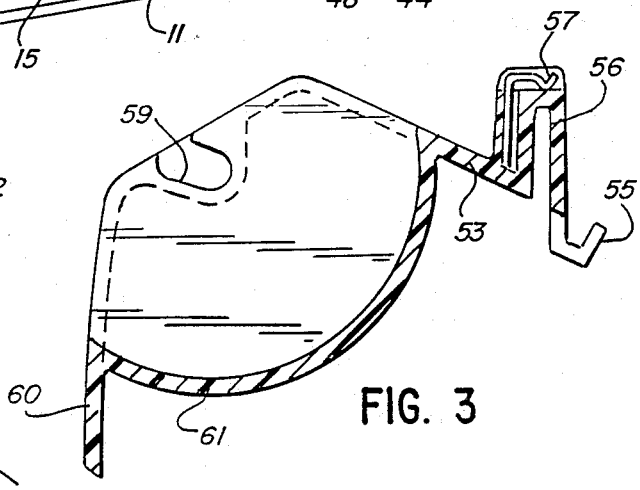
FIG. 3 is a fragmentary enlarged section taken substantially along the line 3—3 of FIG. 2.

As indicated briefly above, the invention further comprehends the provision of means for removably holding office supply objects and devices in association with the paper trimmer. More specifically, as shown in FIG. 1, the invention comprehends the provision of an adhesive tape dispenser generally designated 51 on the rear edge portion 12. As seen in FIGS. 2 and 3, the adhesive tape dispenser comprises a formed wall 52 having a top portion 53 which, as shown in FIG. 1, is flush with the top surface 54 of the base edge portion 12. The top wall portion 53 includes a pair of tangs 55 adapted to engage the undersurface of the rear edge in retaining the wall member 52 on the rear edge portion 12.

The tape dispenser further includes an upstanding boss 56 carrying a knife element 57 for cutting adhesive plastic tape, as from roll 58 mounted to the dispenser, as shown in FIG. 1. The wall member includes notches 59 for receiving the spindle of the tape roll 58 to permit the facilitated withdrawal of the tape from the roll in the normal manner.

As further shown in FIGS. 2 and 3, the tape dispenser further includes a rear depending wall portion 60 at the rear of an arcuate bottom wall 61 defining the bottom of the tape receiving space.

Thus, the invention comprehends the provision of a tape dispenser which is integral with the base in the rear portion 12 thereof.

On the lower portion of the rear edge portion 12, the upper face 54 thereof is provided with a scale 62 and a cooperating slider 63 having a downturned flange 64 received in a groove 65 extending across the rear edge portion 12 of the base between left edge portion and right edge portion 14 thereof. The slider includes an upstanding fingertip manipulating portion 66.

The invention further comprehends the provision of a wall 67 defining means disposed at the left edge portion 13 of the base for defining a plurality of upwardly opening recesses, such as recesses 68, 69 and 70, as seen in FIG.

As shown, the recesses are adapted to removably hold objects, including office supply objects, such as a staple remover 71 in recess 68, paper clips 72 in recess 69, and a stapler 73 in recess 70. The left wall portion 74 of wall 67 is provided with notches 75 and 76 opening horizontally into the recesses 68 and 69, respectively. Notch 75 provides for facilitated withdrawal of the staple remover 71 and notch 76 provides for facilitated manipulation of a cover 77 swingably mounted to the wall 67 for selectively overlying the recess 69 for providing controlled access to the paper clips in the recess 69, when desired.

Figure 4:
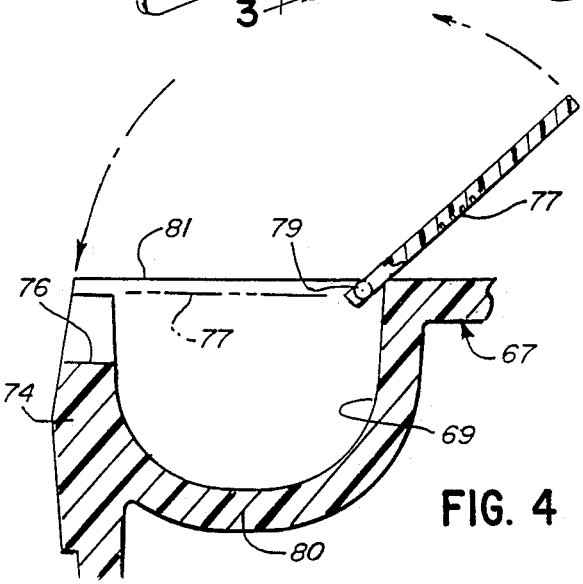
FIG. 4 is a fragmentary enlarged section taken substantially along the line 4—4 of FIG. 1.

As shown in FIGS. 1 and 4, the cover includes pins 79 projecting from its opposite ends and being pivotally received in holes 78 in the end walls at the opposite ends of the recess 69 for swingably mounting the cover between an open position, as shown in full lines in FIG. 4, and a closed position, as shown in broken lines therein. As shown in FIG. 4, the recess 69 may be defined by an arcuate bottom wall 80 for facilitated withdrawal of the paper clips 72 when desired.

Figure 5:
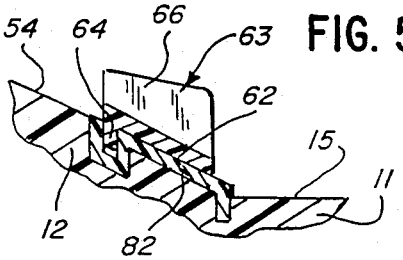
FIG. 5 is a fragmentary enlarged section taken substantially along the line 5—5 of FIG. 1.

Wall means 67 may comprise a separate wall element fixedly secured to the left edge portion 13 of the base. As shown in FIG. 1, the top surface 81 of the wall element may be coplanar with the top surface 15 of the base. Further as shown in FIG. 5, the scale 62 may comprise a separate element 82 fixedly mounted to the lower edge of the rear edge portion 12 of the base. In the illustrated embodiment, the base 11, handle 20, and wall 67 are formed of a molded synthetic resin for facilitated manufacture and low cost. The provision of the paper trimmer formed primarily of such synthetic resin further provides a lightweight trimmer which may be readily moved about in an office for facilitated use thereof Thus, notwithstanding relocation of the paper trimmer, the accessory elements, such as the tape dispenser, stapler, paper clips, and staple remover are automatically moved with the trimmer for maintained availability and neat disposition thereof.

The foregoing disclosure of specific embodiments is illustrative of the broad inventive concepts comprehended by the invention.

We claim:

1. A paper trimmer comprising:

a base defining an upper surface for supporting paper to be cut, opposite side edge portions, and a rear edge portion;

a dispenser on said base rear edge portion; and cutter means disposed at one of said side edge portions of the base for cutting a projecting portion of paper disposed on said base upper surface.

2. The paper trimmer of claim 1 wherein said rear edge portion of the base is provided with a scale and an indicator slidably carried on the rear edge portion adjacent said scale for indicating distance from said paper cutting means.

3. The paper trimmer of claim 1 wherein said dispenser is disposed rearwardly of said scale.

4. The paper trimmer of claim 1 wherein said dispenser comprises an adhesive tape dispenser.

5. The paper trimmer of claim 1 including means for removably mounting said dispenser to said rear edge portion of the base.

6. A paper trimmer comprising:

a base defining an upper surface for supporting paper to be cut, opposite side edge portions, and a rear edge portion;

wall means disposed at one of said side edge portions of the base having a plurality of upwardly opening recesses for removably holding objects including office supply objects;

a dispenser on said base rear edge portion; and cutter means disposed at the other of said side edge portions of the base for cutting a projecting portion of paper disposed on said base upper surface.

7. The paper trimmer of claim 6 wherein said wall means includes cover means for removably covering at least one of said upwardly opening recesses therein

8. The paper trimmer of claim 6 wherein said wall means includes cover means hingedly mounted to said wall means for removably covering at least one of said upwardly opening recesses therein.

9. The paper trimmer of claim 6 wherein said wall means defines an upper surface flush with said upper surface of said base.

10. The paper trimmer of claim 6 wherein said wall means defines a notch opening horizontally into one of said upwardly opening recesses therein.

11. The paper trimmer of claim 6 wherein said wall means defines a plurality of notches opening one each horizontally into a corresponding plurality of said upwardly opening recesses therein.

12. The paper trimmer of claim 6 wherein said rear edge portion of the base is provided with a scale and an indicator slidably carried on the rear edge portion adjacent said scale for indicating distances from said paper cutting means.

13. The paper trimmer of claim 6 wherein said rear edge portion of the base is provided with a scale and an indicator slidably carried on the rear edge portion adjacent said scale for indicating distances from said paper cutting means, said dispenser being disposed rearwardly of said scale.

14. The paper trimmer of claim 6 wherein said dispenser comprises an adhesive tape dispenser.

15. The paper trimmer of claim 6 wherein said wall means is formed unitarily integral with said base.

16. The paper trimmer of claim 6 including means for removably mounting said dispenser to said rear edge portion of the base.

17. The paper trimmer of claim 6 wherein said base and wall means are formed of molded synthetic resin.

18. A paper trimmer comprising:

a base defining an upper surface for supporting paper to be cut;

means mounted to said base for cutting a projecting portion of paper disposed on said base upper surface;

means for dispensing tape mounted to said base; and means for connecting sheets of paper together removably carried on said base.

19. The paper trimmer of claim 18 wherein said means for dispensing tape material comprises an adhesive tape dispenser.

20. The paper trimmer of claim 18 wherein said means for connecting sheets of paper together comprises a stapler.

21. The paper trimmer of claim 18 wherein said base defines an upwardly opening recess and said means for connecting sheets of paper together comprises means removably received in said recess.

22. The paper trimmer of claim 18 wherein said base defines a recess opening upwardly through the plane of said base upper surface and said means for connecting sheets of paper together comprises means removably received in said recess.

23. The paper trimmer of claim 18 further including a staple remover removably carried by said base.

24. The paper trimmer of claim 18 wherein said means for connecting sheets of paper together comprises fasteners.

25. The paper trimmer of claim 18 wherein said base defines an upwardly opening recess and said means for connecting sheets of paper together comprises paper clips removably received in said recess, and further including a cover removably covering said recess.

26. The paper trimmer of claim 18 wherein said base defines an upwardly opening recess and said means for connecting sheets of paper together comprises paper clips removably received in said recess, and further including a cover movably mounted to said base for removably covering said recess.

27. A paper trimmer comprising:

a base defining an upper surface for supporting paper to be cut, opposite side edge portions, and a rear edge portion;

wall means disposed at one of said side edge portions of the base having a plurality of upwardly opening recesses for removably holding objects including office supply objects;

a dispenser on said base rear edge portion; and cutter means disposed at the other of said side edge portions of the base for cutting a projecting portion of paper disposed on said base upper surface, said cutter means including a fixed blade on said base and a movable blade pivotally mounted to said base, and cam means for resiliently biasing said movable blade against said fixed blade during a paper cutting operation.

28. The paper trimmer of claim 27 wherein said cam means comprises means for spacing said movable blade from said fixed blade in a retracted disposition of the movable blade.

29. The paper trimmer of claim 27 further including means for selectively locking said movable blade against movement away from said fixed blade.

* * * * *